US007895682B1

(12) United States Patent
De Nyse

(10) Patent No.: US 7,895,682 B1
(45) Date of Patent: Mar. 1, 2011

(54) TOILET VENTILATION SYSTEM

(76) Inventor: Robert De Nyse, Buford, GA (US)

( * ) Notice: Subject to any disclaimer, the term of this patent is extended or adjusted under 35 U.S.C. 154(b) by 0 days.

(21) Appl. No.: 10/720,474

(22) Filed: Nov. 25, 2003

(51) Int. Cl.
*E03D 9/052* (2006.01)

(52) U.S. Cl. ..... 4/213

(58) Field of Classification Search ..... 4/213
See application file for complete search history.

(56) References Cited

U.S. PATENT DOCUMENTS 2,074,211 A * 3/1937 Churchill ..... 4/213
2,238,461 A * 4/1941 Carman ..... 4/213
3,849,808 A * 11/1974 Olson et al. ..... 4/213
6,463,595 B2 * 10/2002 Prisco et al. ..... 4/213
6,496,986 B1 * 12/2002 Lumsden ..... 4/213

* cited by examiner

*Primary Examiner* — Robert M. Fetsuga

(57) ABSTRACT

Negative pressure is: (a) applied through a shallow manifold inlet fitted between the rear of a toilet porcelain bowl and hinged seat; (b) created by a remote blower; (c) conveyed via conduit. An adjustable hood in front of the manifold optimizes odor collection. The blower can be located in a housing possessing multiple inlet ports for connection to a plurality of manifolds. The blower can also be used in line with conduit and multiple blowers utilized. A sensor port in a manifold extension facilitates empirical verification of air flow. Electrical supply to the blower can be controlled by a light switch: (a) independently; or with: (b) a vent that can be exhausted through the same conduit, or (c) a humidity blower. Plastic and metal conduit of differing cross section are joined with an adapter and either connected to a blower housing inlet port. PVC conduit is disposed within wall frames hung from the sill.

33 Claims, 5 Drawing Sheets

FIGURE 2
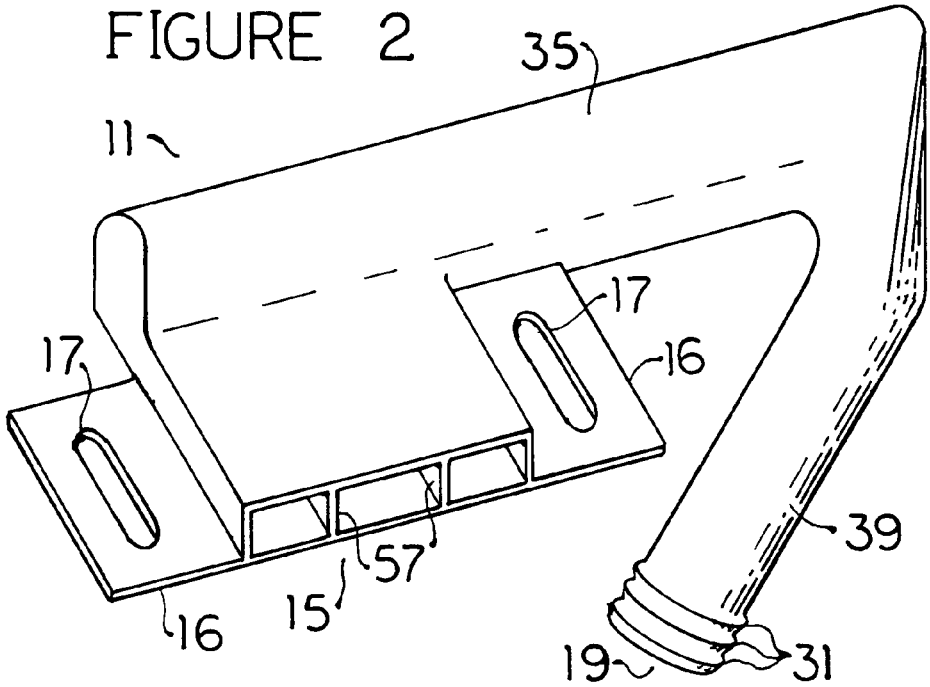
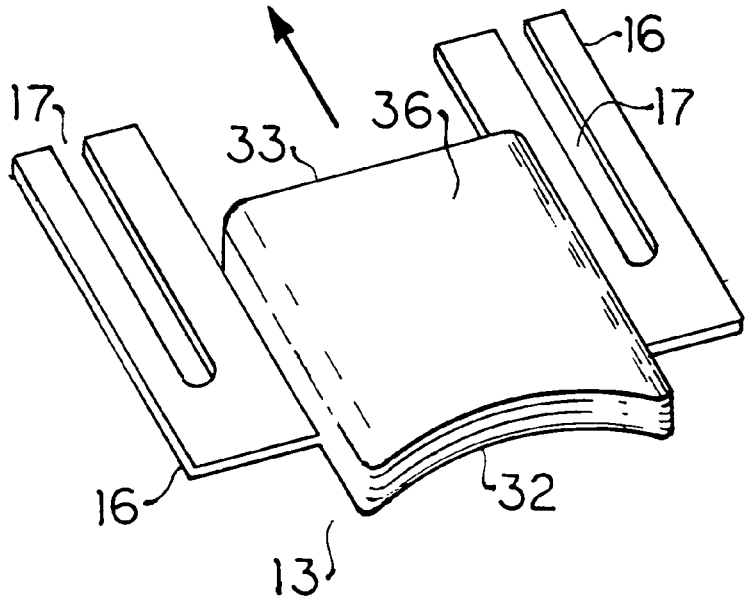
FIGURE 3

FIGURE 8
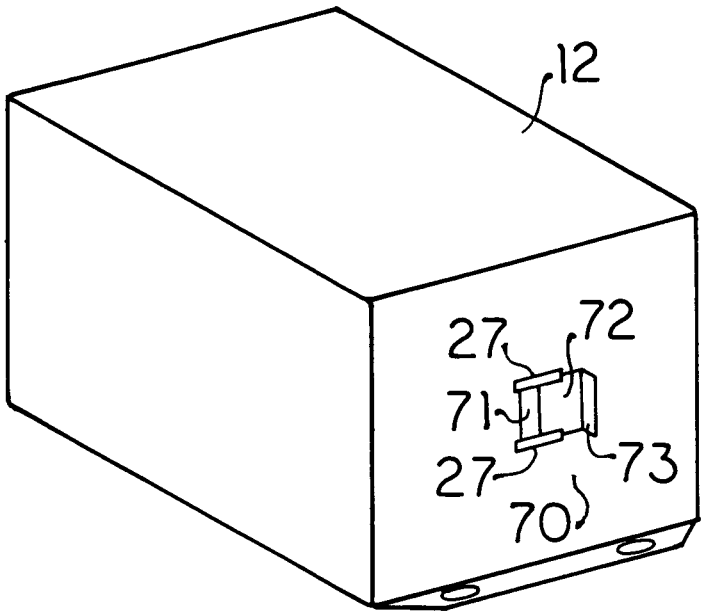
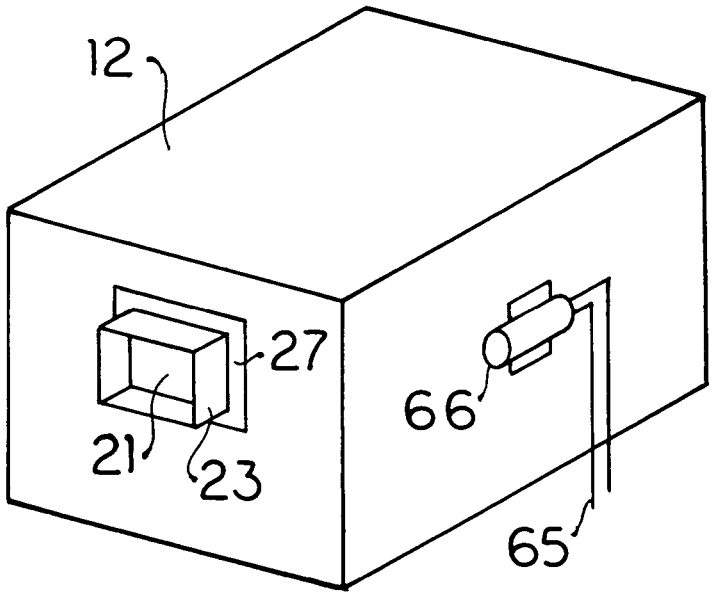
FIGURE 9

TOILET VENTILATION SYSTEM

BACKGROUND OF THE INVENTION

1. Field of the Invention

The present invention is concerned with the removal of odors coincident with disposal of human bodily wastes into a toilet porcelain bowl having a hinged seat by supply of negative pressure in ventilation thereof.

2. General Background

The modern flush toilet, invented by John Crapper, is first recognized as being the single most important amenity of modern civilization without which widespread disease and the prevalent odor of human feces in the streets of all cities would remain in oppression of urban humanity. Chorea, typhoid, dysentery and other deadly diseases have been virtually eradicated from civilization by the invention of John Crapper and the usage of associated sewage systems.

The repeated outbreak of chorea in Chicago in the 1870s and 80s resulting in the last instance of over 30,000 deaths is testimony to the importance of modern sanitation systems as is its solution: the reversal of the South Branch of the Chicago River and its continuation through the Chicago Sanitary and Shipping Canal from Calumet to the Mississippi River. This, and the 'deep tunnels' providing Manhattan with both potable water from hundreds of miles upstate and sewage disposal for Gotham denizens, are among the largest and most important engineering feats of the modern age. Uncounted dozens died in the creation of the latter and more continue to perish in building its replacement.

At the present time perhaps the most pervasive reminder of the threat posed by unsatisfactory disposal of human excrement is the odor associated with disposal of the same into the porcelain bowl of a modern flush toilet while sitting upon the generally flat and annularly ovoid shaped hinged seat disposed in parallel, and in spaced apart contact with, the generally flat top surface of the porcelain bowl. Exhaust ventilation of the room having this facility will succeed in preventing the migration of these noxious odors beyond the confines of the same but, obviously, fails to prevent the author of the odors from subjugation to this most unpleasant assault upon the olfactory senses. It is noted that the repulsion triggered through the olfactory system of the human body by these odors is a defense mechanism as human feces carries deadly pathogens and therefore this repulsion is generally universal to the human species and decidedly severe.

3. Discussion of the Prior Art

A large number of U.S. patents are known to attempt address of the present problem. In chronological order since the commencement of the latest millennium, as commonly if incorrectly understood to begin with Jan. 1, 2000, one has:

| # | U.S. Pat. No. | Inventor | Title |
|---|---|---|---|
| 1 | 6,019,862 | Carwell et al. | Method of Making Integrated Toilet Bowl Exhaust System; |
| 2 | 6,029,286 | Funk | Odor Removing Apparatus for Toilets; |
| 3 | 6,041,449 | Brown et al. | Apparatus and Method for Treating Objectionable Odors in Toilet Bowls and the Like; |
| 4 | 6,073,273 | Tillen | Venting Apparatus for Flush Toilets; |
| 5 | 6,158,058 | Martens | Ventilated Toilet; |
| 6 | 6,167,576 | Sollami | Ventilated Toilet Seat; |
| 7 | 6,173,453 | Shahar | Toilet Venting System; |
| 8 | 6,209,146 | Gonzalez | Ventilation Device for a Toilet; |
| 9 | 6,219,853 | Johnson | Toilet Ventilation System; |

-continued

| # | U.S. Pat. No. | Inventor | Title |
|---|---|---|---|
| 10 | 6,052,837 | Norton et al. | Toilet Ventilation System; |
| 11 | 6,233,750 | Donald et al. | Toilet Bowl Ventilating Apparatus; |
| 12 | 6,279,173 | Denzin et al. | Devices and Methods for Toilet Ventilation Using Radar Sensor; |
| 13 | 6,295,656 | Tillen | Venting Apparatus for Flush Toilets; |
| 14 | 6,298,500 | Sollami | Ventilated Toilet Seat; |
| 15 | 6,360,377 | Sollami | Filtration Housing Unit for Use with a Ventilated Toilet Seat; |
| 16 | 6,363,542 | Pope, Sr. | Toilet Ventilator; |
| 17 | 6,367,092 | Carwell et al. | Charge Transfer Capacitance Sensing and Control System for an Integrated Venting System; |
| 18 | 6,370,702 | Iddings, Sr. | Toilet Enclosure with Ventilation System; |
| 19 | 6,370,703 | Kim et al. | Odorless Toilet; |
| 20 | 6,457,186 | Stewart | Air Cleaning Device for a Toilet Seat. |

4. Statement of Need

At least twenty U.S. patents attempting to address the problem of noxious odors associated with the disposal of human bodily wastes into the porcelain bowl of a modern flush toilet while sitting on the hinged seat to the same have issued within less than three years prior to the present writing. The number and frequency of these is considered testimony to the pervasiveness, severity, and persistence of the problem. A poignant need for an effective means of removing the odor associated with disposal of human bodily wastes into the porcelain bowl of a modern flush toilet while sitting upon the hinged seat of the same is hence considered to exist.

SUMMARY OF THE INVENTION

Objects of the Invention

The encompassing object of the present invention is the removal of odors associated with the disposal of human bodily waste into the porcelain bowl of a modern flush toilet whilst sitting upon the hinged seat of the same.

A first auxiliary object of the present invention is the removal of odors associated with the disposal of human bodily waste into the porcelain bowl of a modern flush toilet whilst sitting upon the hinged seat of the same in a manner that introduces no safety hazards.

A second auxiliary object of the present invention is the removal of odors associated with the disposal of human bodily waste into the porcelain bowl of a modern flush toilet whilst sitting upon the hinged seat of the same in a manner that is unobtrusive to the user.

A third auxiliary object of the present invention is the removal of odors associated with the disposal of human bodily waste into the porcelain bowl of a modern flush toilet whilst sitting upon the hinged seat of the same in a manner that is applicable to a large range of sizes of toilet.

A fourth auxiliary object of the present invention is the removal of odors associated with the disposal of human bodily waste into the porcelain bowl of a modern flush toilet whilst sitting upon the hinged seat of the same in a manner that minimizes duct work required of installation.

A fifth auxiliary object of the present invention is the removal of odors associated with the disposal of human bodily waste into the porcelain bowls of a plurality of flush toilets in a building whilst sitting upon the hinged seat of any of the same.

Other ancillary objects of the present invention include automatic activation and applicability to both residential and commercial buildings.

In achievement of the above stated objects of the present invention it is suggested that a negative pressure differential with respect to ambient be applied proximate the back of the top of the porcelain bowl of a standard flush toilet, that a remote blower be used to supply this negative pressure differential, and that the remote blower be connected by conduit to a manifold adapted to possess an appropriately located and disposed inlet.

It is suggested that the standard spacing between the mounting bolts connecting the hinged seat, and typically a hinged lid also, be utilized for location of the manifold and its inlet specifically utilizing two slots, one each presented by opposed lateral wings, each possessing a width sufficient to admit one said mounting bolt. The manifold can then be readily located for use upon any flush toilet having standard spacing between the bolts utilized for connection of a hinged seat thereto. It is also suggested that the manifold inlet possess a sufficiently diminutive height for allowing location between the top annular substantially flat surface of the porcelain bowl and the bottom flat surface of the hinged seat without replacement of the existing bolts or seat.

It is suggested that relatively small, in comparison with typical rectangular cross section ventilation duct work, annular cross section, i.e. round, conduit be utilized between the manifold and the remotely located blower. It is specifically suggested that standard polyvinyl chloride (PVC) schedule 40 piping with an interior diameter of about one and one half inches be utilized throughout both residential and commercial applications. This enables the conduit to be disposed in plumbing passageways and to be hung within wall frames by the sill. It is suggested that the remotely located blower be located in a housing facilitating multiple conduit connections for a plurality of manifolds each located upon a separate flush toilet within the same building. And it is suggested that an adapter be utilized for connection of lengths of conduit of differing cross section to each other and the blower housing.

In optimization of the air flow dynamics of the inlet of the manifold proximate the top surface of the porcelain bowl of a typical flush toilet, and in accommodation of the varying depth dimensions from fore to aft of these porcelain bowls, it is suggested that a hood possessing a pair of slots spaced apart the same distance as the two slots on the manifold, i.e. the standard distance between the bolts connecting the hinged seat to the porcelain bowl, be provided. The hood can extend over a rear portion of the top of the interior of the porcelain bowl and the inlet of the manifold proper be disposed between the top substantially flat surface of the porcelain bowl and the bottom flat surface of the hinged seat spaced apart substantially in parallel thereabove.

It is suggested that the manifold and the hood both be constructed in plastic. This, and the use of a remote blower and plastic conduit, are considered to minimize any potential problems regarding corrosion or unwanted conduction of electricity occasioned by proximity to water in the porcelain bowl of a human waste disposal flush toilet or any other water in the room in which said toilet is located. Use of a blower remote from the porcelain bowl of a flush toilet, and from any and all sources of water in the room in which the toilet is located, minimizes the safety hazard otherwise poised by location of standard alternating current supplied electrical motors in the same room.

It is suggested that electrical supply to the remote blower be activated by a wall mounted light switch for the room in which each flush toilet with a manifold attached thereto is located and that the separate vent for excessive humidity commonly required for bathrooms having a shower or bath be connected via conduit to the remote blower exhausting to the exterior of the building through conduit connected to an exhaust port of the blower housing.

Flexible hose connecting the manifold to the rigid conduit is further suggested to facilitate ease in installation. Use of either: (a) annular barbs upon a manifold extension and a hose clamp for conventional connection; or (b) a rigid fastened flanged hose connection to the manifold outlet facilitating quick and easy disconnection are suggested.

Other advantages and benefits of preferred embodiment of the principles relating to the present invention may be appreciated in the detailed description following; particularly if conducted with reference to the drawings attached hereto briefly described immediately below.

BRIEF DESCRIPTION OF THE DRAWINGS

FIG. 2 is an isometric view of a manifold in preferred accordance with the principles relating to the present invention.

FIG. 3 is an isometric view of a hood in preferred accordance with the principles relating to the present invention.

FIG. 8 is an isometric view of the back of the blower housing depicted in FIG. 4 depicting a regulator.

FIG. 9 is an isometric view of a blower housing similar to that depicted in FIG. 4 having a rectangular exhaust port.

| NOMENCLATURE | |
|---|---|
| 10 | flush toilet |
| 11 | manifold |
| 12 | blower housing |
| 13 | hood |
| 15 | manifold inlet |
| 16 | wing |
| 17 | slot |
| 19 | manifold outlet |
| 20 | blower |
| 21 | exhaust port |
| 22 | inlet port |
| 23 | sleeve |
| 25 | dual size conduit inlet port |
| 26 | reduction plate |
| 27 | flange |
| 29 | bolt hole |
| 30 | conduit |
| 31 | annular barbs |
| 32 | fore edge |
| 33 | rear edge |
| 35 | manifold plenum |
| 36 | medial section |
| 37 | hose connector |
| 39 | manifold extension |

-continued

| NOMENCLATURE | |
|---|---|
| 50 | annular projection |
| 51 | gasket |
| 52 | sensor port |
| 53 | adapter |
| 55 | vent |
| 56 | light switch |
| 57 | vertical vanes |
| 59 | aperture |
| 60 | hanger |
| 61 | female end |
| 62 | shoulder |
| 63 | frame sill |
| 65 | wiring |
| 66 | relay |
| 67 | circuit board |
| 69 | power supply |
| 70 | regulator |
| 71 | orifice |
| 72 | door |
| 73 | handle |

DETAILED DESCRIPTION OF PREFERRED EMBODIMENT

Figure 1:
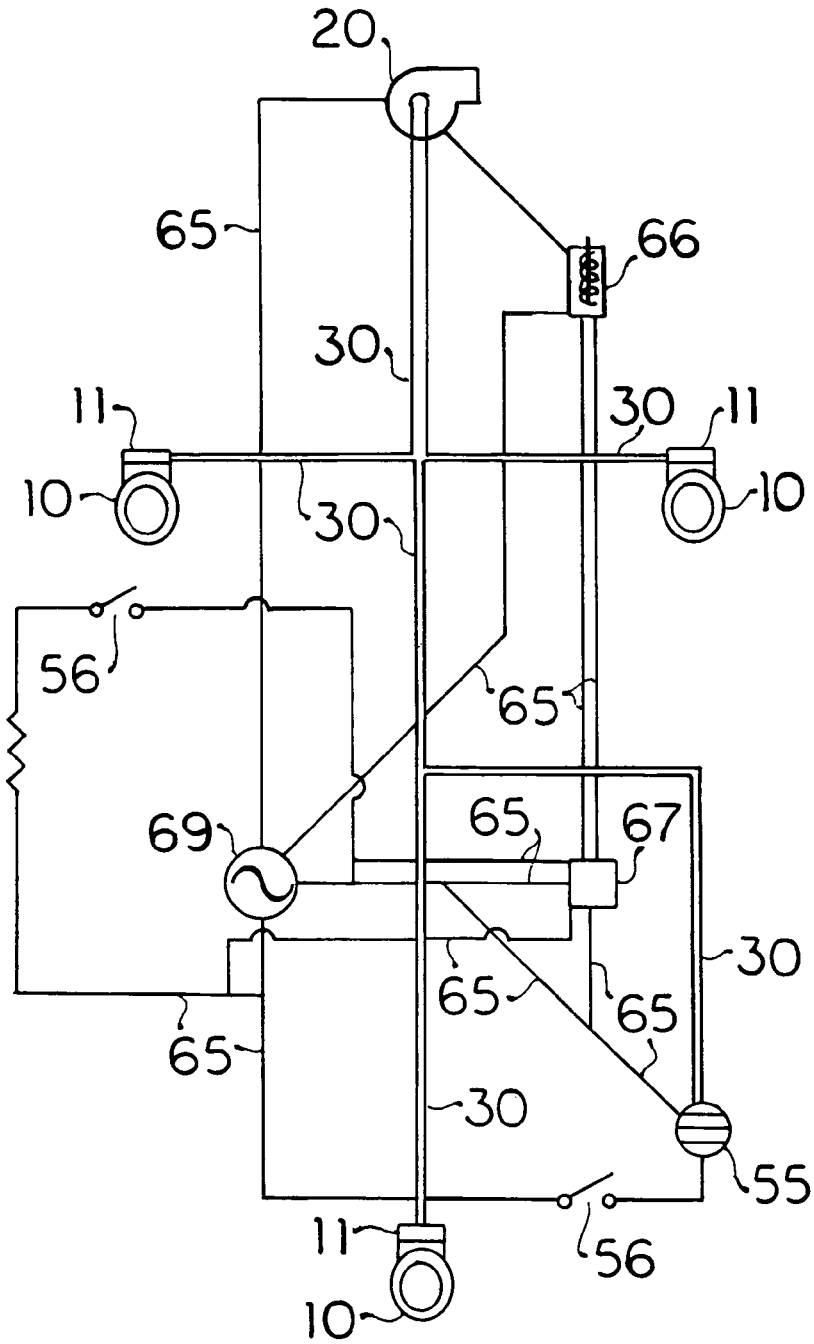
FIG. 1 is a schematic view of a system in preferred accordance with the principles relating to the present invention providing a plurality of ordinary flush toilets in a single building with noxious odor removal.

FIG. 1 schematically depicts a ventilation system in preferred accordance with the principles relating to the present invention operative upon a plurality of flush toilets 10 each possessing a porcelain bowl with a substantially flat top surface and a seat hinged thereto possessing a flat bottom disposed, in operative position, substantially parallel to and spaced apart from the top surface of the porcelain bowl. The porcelain bowl, seat, and other components of the flush toilets 10 are well known and are hence undepicted in the drawings attached hereto. The size of the porcelain bowls vary, particularly in depth from front to rear including the cavity thereto and incidentally the associated seats, and a hood 13 adjustable during installation with respect to a manifold inlet 15 disposed at the back of the space between the top surface of the porcelain bowl and the bottom surface of the hinged seat accommodates this variation. Perhaps most importantly, it is noted that the hinged seat of a standard flush toilet 10 in the U.S.A. is attached to the porcelain bowl by a pair of mounting bolts that are spaced apart from each other a standard distance of five and one half inches center to center regardless of the size.

The conduit 30 seen in FIG. 1 also is simply represented as no depiction is considered necessary or desirable. The conduit 30 utilized in preferred embodiment of the principles relating to the present invention is well known and requires no modification: Schedule 40 PVC piping with an internal diameter (ID) of approximately one and a half inches (1.5"). Use of flexible hose that can be fitted, and preferably glued, to this PVC piping is recommended for connection of the manifold outlet 19 depicted in FIG. 2 to this conduit 30 and annular barbs 31 provided for this. Alternatively, or in addition, a standard hose clamp of appropriate diameter, i.e. about one and seven eighths inches (1.875") can be tightened about the flexible hose on either connection of the hose ends.

The most preferred connection of the manifold outlet 19 to the conduit 30 uses PVC flexible hose that can be effectively glued to PVC conduit or PVC connectors and a hose connector 37 facilitating a quicker and easier manual disconnection, preferably without the use of tools, than achievable with use of a hose clamp with or without annular barbs 31 on the manifold extension 39 or a conduit 30 connector.

Figure 5:
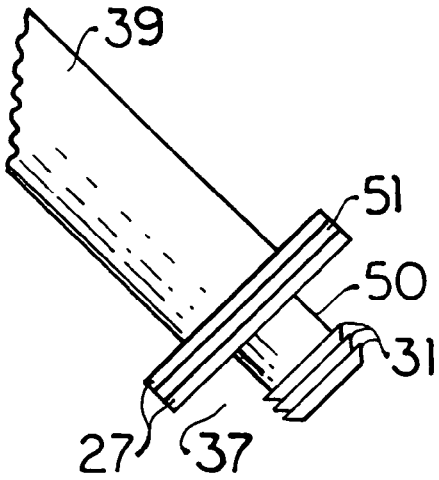
FIG. 5 is a plain elevational detail view taken from a side of a flanged conduit connection.

A hose connector 37 is seen FIG. 5 to have an annular projection 50 possessing an exterior adapted to engage the interior of the flexible hose and has flanges 27 butted against the flanges 27 of the manifold extension 39. It is recommended that the hose connector 37 be made of PVC, that a resilient gasket 51 possessing a matching ID be disposed therebetween to ensure an air tight seal and that appropriate fasteners, not shown, such as a pair of toggle clamps or wide pitch bolts and wing nuts, be used to fasten the two opposed pairs of flanges 27 together with the fasteners passed through the bolt holes 29 in the flanges 27. It is suggested that flexible PVC hose be used so it can be effectively glued to the annular projection 50 and hose clamps are unnecessary to secure the connection. It is emphasized that this connection of the manifold outlet 19 to the conduit 30 may be by any means desired, that any functional equivalent fulfills the principles of the present invention.

It is also emphasized that schedule 40 PVC piping comprises the preferred conduit 30 but other sizes and other materials will suffice to fulfill the necessary function of the conduit 30 in preferred embodiment of the principles relating to the present invention. It is also suggested that round, preferably three inch (3") ID, metal duct be used in connection to the inlet ports 22 and exhaust port 21 particularly on the blower housing 12 in commercial buildings as in standard practice. The exhaust in any case is to the exterior of the building through conduit 30. The use of larger diameter conduit 30 from the exhaust port 21 of a blower housing 12, or the blower 20 directly, reduces back pressure considerably upon the blower 20, and improves system performance.

It is commented that staged increases in the size of the air path are observed in a system in preferred accordance with the principles relating to the present invention facilitating effective supply of negative pressure differentials to a plurality of manifold inlets 15 using a single blower 20 located in a single blower housing 12. The manifold inlets 15 are of lesser area than schedule 40 PVC conduit 30, as demonstrated further below, and 3" diameter metal duct has an interior area that is much larger still. It is further considered desirable to accommodate use of both sizes of these types of conduit 30 in connection to the blower housing 12. A dual size conduit inlet port 25 comprised of: a reduction plate 26 with an aperture 59 for disposition of a male/female PVC connector; a gasket 51; and a 3" diameter sleeve 23 with a annular flange 27 as depicted in FIG. 4 on one of the inlet ports 22 of the blower housing 12 facilitates fixed connection of either schedule 40 PVC or 3" diameter metal conduit 30.

The annular flange 27 of the sleeve 23 is seen to possess a plurality of bolt holes 29 intended to match a set of bolt holes 29 of the same pattern through the wall of the blower housing 12, the reduction plate 26, and the gasket 51 fitted between the reduction plate 26 and the exterior surface of the wall of the blower housing 12 with sheet metal bolts acting upon the flange 27 of the sleeve 23 and compressing the assembly together in fastening the same with engagement of the bolt holes 29 in the wall of the blower housing 12. All of the bolt holes 29 here have the same pattern but the set through the wall of the blower housing 12 are intended to have a diameter approximating the root diameter of the bolts used while the other bolt holes 29 are intended to have a diameter allowing free passage of the greater full thread diameter of the bolts used. Ordinary sheet metal bolts or screws are suggested.

Figure 4:
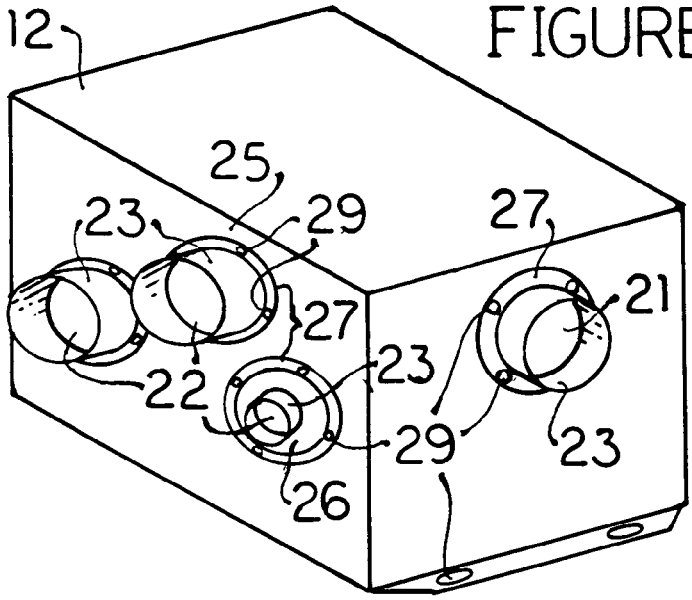
FIG. 4 is an isometric view of a blower housing in preferred accordance with the principles relating to the present invention including depiction of a dual size conduit connector on an inlet port.

The blower housing 12 seen in FIG. 4 is preferably constructed in sheet metal. A blower 20 is preferably bolted in position inside the blower housing 12 using the bolt holes 29 seen in FIG. 4 on either side of the exhaust port 21. An external sleeve 23 may also be seen projecting outwardly from the exhaust port 21 and is intended to be fitted interiorly to the conduit 30 used for exhaust in a conventional manner preferably using 3" metal conduit 30. Installation of a length of PVC conduit 30 into an inlet port 22 using the aperture 59 provided by the reduction plate 26 can use an ordinary male to female PVC connector, not shown, disposing the male end through the aperture 59 and pulling the shoulder of the connector against the exterior surface of the reduction plate 26 with a lock ring, also not shown) threaded onto the male end of the connector and tightened against the interior surface of the reduction plate 26.

The blower housing 12 may have any desired number of inlet ports 22 and the inlet ports 22 that are unused can simply be closed by plugs, not shown, that can be threaded to be engaged by a lock ring and extend interiorly against a positive stop created by a flange 27. Or, more simply, a flanged metal plug with compressible insert can be utilized or any other type of fire proof plug preferably avoiding the use of duct tape although this also will obviously suffice to seal the blower housing 12. It is expected that the blower 20 will need to be sized to economically provide the negative pressure for all the manifolds 11 concerned. A sensor port 52, as earlier mentioned, is considered very useful for this.

Figure 7:
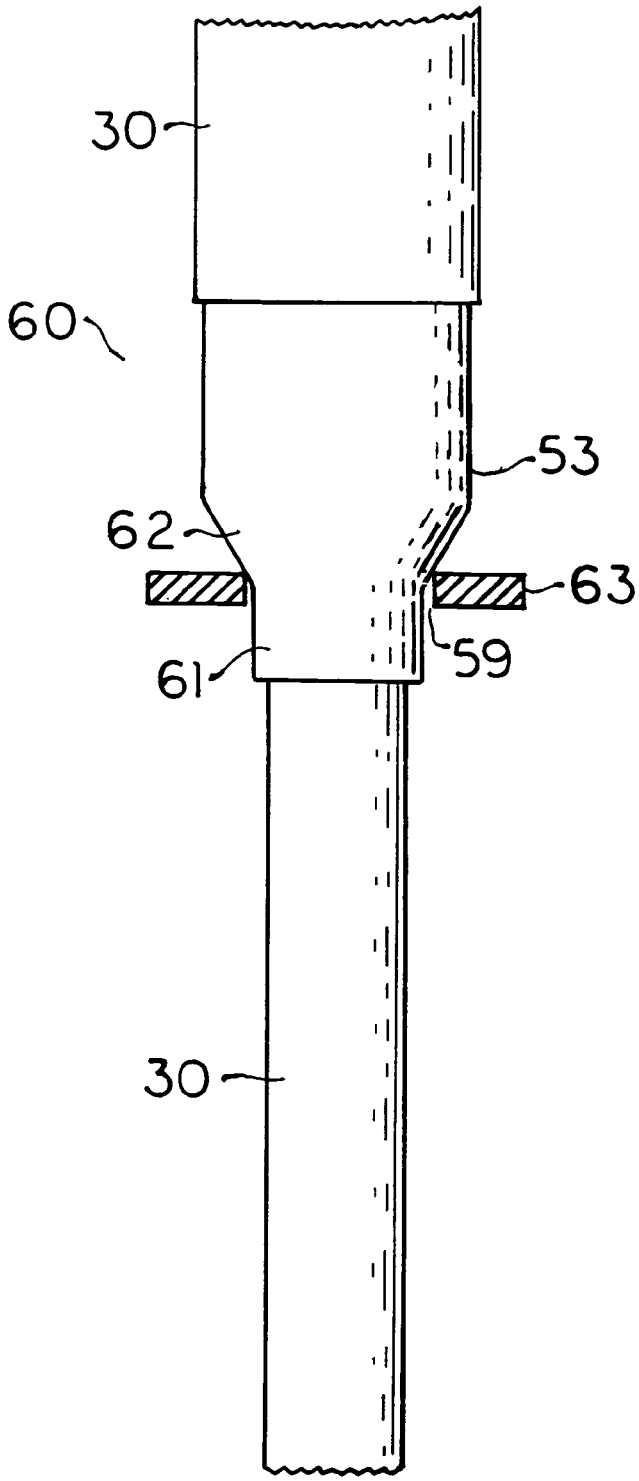
FIG. 7 is a plain elevational view taken from a side of an adapter for lengths of conduit possessing differing sizes used as a hanger in a frame sill of a wall for hanging schedule 40 PVC conduit therein.

The adapter 53 depicted in FIG. 7 is specifically suited to adapt schedule 40 PVC piping preferred for use as conduit 30 wherever possible in a system in preferred accordance with the principles relating to the present invention. In most residential structures this is the only type of conduit 30 preferred except for flexible hose connecting to the manifold extension 39 and ordinary 3" diameter metal duct for exhaust. It is noted that a blower housing 12 isn't strictly necessary although increasing the area of the airway, particularly behind the blower 20, is desirable to minimize back pressure and in order to minimize expense it is hence recommended that schedule PVC conduit 30 be used up to the blower 20 or blower housing 12 and 3" diameter metal duct for exhaust.

An adapter 53 such as that shown in FIG. 7 be used to connect the PVC conduit 30 on one side to metal conduit 30 on the other side if it is desired to run 3" diameter metal conduit 30 through a building plenum to the blower housing 12. The metal conduit 30 recommended is ordinary galvanized mild steel ducting. Square or rectangular metal duct can also be used. Extensive engineering has been conducted especially with regard to the use of schedule 40 PVC piping as the conduit 30 conveying the negative pressure created by a blower 20 in a blower housing 12 to a manifold 11 as specifically depicted in the drawing figures attached hereto and, in brief, satisfactory air flow for several relatively long lengths of conduit 30 including that for several vents 55 is readily obtained although this is perhaps contrary to conventional expectations.

Schedule 40 PVC piping is very inexpensive and can be run through plumbing passageways, including the space within the frame of a wall, while standard large rectangular metal duct cannot. This is considered to provide a valuable attribute regardless of whether the building concerned is commercial or residential as use of schedule 40 PVC enables the conduit 30 to be hung from the frame sill 63 of a wall as depicted in FIG. 7. The hanger 60 shown therein uses an adapter 53 with one female end 61, i.e. tapped, and a tapered shoulder 62 of greater diameter than the aperture 59 cut through the frame sill 63 and sized to permit passage of the female end 61. The upper end of a measured length of schedule 40 PVC conduit 30 is placed through the aperture 59 in the frame sill 63 and threaded into a female end 61, preferably by threading and glueing, and is dropped into position.

It is noted that exhaust ventilation only required in the U.S.A. to disperse excessive humidity or fog commonly created by a hot shower or bath. An internal blower without any exhaust venting, often combined with an electrical resistive heating element, is hence a commonplace in bathrooms. A 'bathroom' having a flush toilet 10 but no shower or bathtub is not required to have any ventilation.

Lavatories in commercial buildings having many flush toilets 10 but no shower or bathtub are not required by code to have ventilation. In these cases a system in accordance with the principles relating to the present invention remedies an obvious problem. In cases wherein a true vent 55 exists or is intended for a 'bathroom' or lavatory possessing at least one flush toilet 10 it is suggested that the duct for the same be combined with the conduit 30 of the present invention. For the purposes of meeting building code requirements in the U.S. it is noted that 50 cubic feet per minute of air flow is required and that the air flow through the manifold inlet 15 and the vent 55 may be combined to meet this requirement and hence a single conduit 30 and remote blower 20 for the 'bathroom' suffice.

The blower 20 represented in FIG. 1 is also a well known component, a purchased item, and is hence also undepicted in the drawings attached hereto. The blower 20 requires an electrical power supply 69 and is remotely located with respect to the manifold 11. It is recommended blower 20 operation be controlled with operation of a light switch 56 in the rooms possessing flush toilets 10 and that a circuit board 67, at least one relay 66 and appropriate wiring 65 be utilized. And if the conduit 30 conveying negative pressure to the manifold inlet 15 proximate the back of the porcelain bowl of a flush toilet 10 is combined with the conduit 30 suppling exhaust for a separate vent 55 in the same room it is further recommended that the remotely located blower 20 create the negative pressure differential required of both.

A rotary vane alternating current (AC) 'squirrel cage' type blower is considered appropriate for the blower housing 12 depicted in FIG. 4 but any type of blower 20 can be utilized in preferred embodiment of the principles relating to the present invention. A blower housing 12, in fact, is not strictly necessary to fulfillment of said principles as a sufficiently diminutive blower can be located within the conduit 30. An integrated circuit controlled rotating field direct current axial flow blower of the type commonly used for cooling personal computers can easily be disposed in line with the conduit 30 for example and more than one such blower 20 can be utilized in the same line if desired for purposes of providing sufficient negative pressure at the manifold inlet 15.

If there is conduit 30 down stream from the exhaust port 21 or a very long length of conduit 30 between the manifold outlet 19 and the exhaust port 21 or a large number of bends, particularly 90°, in the conduit 30 it is suggested that more than one in-line blower 20 be utilized and specifically suggested that a pair of counter rotational blowers 20 be closely, about the diameter of the vanes, spaced apart from each other to maximize the air flow sustained and minimize back pressure hindering the same.

The use of a blower housing 12, however, and a conventional AC blower 20 obviates these concerns and facilitates the supply of negative pressure relative to ambient pressure, i.e. less than 14.69 psia or 0 psig; to the manifold inlets 15 of a plurality of manifolds 11 each connected by a separate line of conduit 30 to the blower housing 12 as represented schematically in FIG. 1. A number of flush toilets 10 are economically serviced in this manner. It is, of course, sufficient with regard to the present invention to service only one flush toilet 10 regardless of the use of a blower housing 12.

The manifold inlet 15, as mentioned before, must be sufficiently shallow to fit between the top substantially flat surface of the porcelain bowl of an ordinary flush toilet 10 and the bottom flat surface of the seat hinged thereto. The distance between these two surfaces is typically a little more than, but can be as little as, one half of an inch (0.500") and it is hence suggested that the total height of the manifold inlet 15 be restricted to this measure. The suggested diameter of the conduit 30 connected to the manifold 11, inclusive of rigid pipe or duct or flexible hose, is larger than this and hence it is suggested that the manifold outlet 19 possess an effective diameter substantially greater in dimension than the height of the manifold inlet 15.

The manifold 11 specifically depicted in FIG. 2, taken directly from engineering prints for prototypical manufacture, has a manifold inlet 15 three and three eighths inches (3.375") wide and three eights of an inch (0.375") high. This respectively includes four and two walls all approximately one sixteenth of an inch (0.0625") thick. The resulting air passage is hence $[3.375"-(4)(0.0625")]\times[0.375-(2)(0.0625")]=[3.125"]\times[0.250"]=0.78125\ in^2$. The manifold outlet 19 has an ID of 1.319" and a passage of $\pi(r)^2=\pi(ID/2)^2=\pi(0.6595")^2=3.1415962(0.6595)^2=1.3664\ in^2$. The manifold outlet 19 hence possesses a passage that is $1.3664\ in^2/0.78125\ in^2=1.75$ times greater than that possessed by the manifold inlet 15.

Physics dictates that the air flow through each be the same, as the manifold 11 has no other openings, and hence the velocity of the air flow through the manifold inlet 15 is 1.75 times greater than that through the manifold outlet 19. A manifold plenum 35 with a rounded top is located behind the manifold inlet 15, connecting it to a laterally located manifold extension 39 having the annular cross section manifold outlet 19 at its termination. This rounded top facilitates laminar flow from the necessarily shallow and wide manifold inlet 15 to the preferably annular manifold outlet 19. Laminar flow is preferred over turbulent flow in being more efficient, quieter, and more effective in removal of odors.

Figure 6:
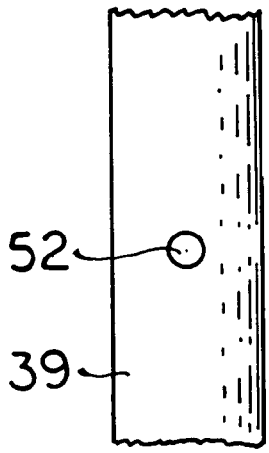
FIG. 6 is a plain elevational detail view taken from the bottom of a portion of the manifold extension illustrating a sensor port therethrough.

A sensor port 52 is preferably provided, as seen in FIG. 6, through the underside or bottom surface of the manifold extension 39 for insertion of an airflow probe to provide the velocity of the air flow and hence, with the cross sectional area of the manifold extension 39 known, the volume rate of air flow is readily yielded. This is considered a significant and valuable feature as it provides empirical, objective, verification that a system in accordance with the principles relating to the present invention has been properly installed and is functioning properly. Assistance during installation in sizing the blower 20 is considered to be the most significant direct benefit of this.

The hood 13 depicted in FIG. 3 is considered vital to both proper installation and operation of a toilet ventilation system in accordance with the principles relating to the present invention. As mentioned earlier, the porcelain bowls of typical, modern, flush toilets 10 in the U.S. vary dimensionally. Every dimension varies except the standard spacing between the mounting bolts for the hinged seat and, typically, lid. The width and, most importantly, the length: from fore to aft; of the porcelain bowl varies. The width of the manifold inlet 15 is restricted by the distance between the two mounting bolts. The height of the same is restricted by the space between the top surface of the porcelain bowl and the bottom surface of the seat hinged thereto.

The position of the manifold inlet 15 with respect to the porcelain bowl is determined by the difference between the actual and the minimum distance between the cavity of the porcelain bowl and the back of the exterior of the same because the manifold plenum 35 necessarily extends below the top surface of the porcelain bowl behind the same and the front of the manifold 11: the manifold inlet 15 cannot extend beyond the rear edge of the porcelain bowl cavity on the smallest model. The effectiveness of the negative pressure differential or suction supplied by the remote blower 20 through the conduit 30 to the manifold inlet 15 in removing noxious odors resulting from defecation, primarily, into the flush toilet 10 depends upon proximity of the manifold inlet 15 with the source of the odor.

For this reason a hood 13 is supplied with a curved fore edge 32 to the medial section 36 preferably possessing a curvature approximating that of the cavity of the porcelain bowl of the flush toilet 10. The rear edge 33 of the medial section 36 of the hood 13 is straight as it overlaps the top surface of the manifold 11 between the two wings 16 each with a slot 17 for attachment to the mounting bolts for the hinged seat of the flush toilet 10. The wings 16 of the hood 13 are long enough to ensure this overlap even on the largest length of porcelain bowl. On smaller bowls the wings 16 are trimmed off.

The open slots 17 of the wings 16 of the hood 13 are intended, as are the closed slots 17 in the wings 16 of the manifold 11, to be engaged by the pair of uniformly spaced apart hinged seat mounting bolts on a standard flush toilet in the U.S. which, in installation, are loosened and then tightened after locating the exterior of the manifold plenum 35 against the rear of the porcelain bowl and the hood 13 such that the rear edge 33 of the medial section 36 overlaps the top of the manifold 11, including the manifold inlet 15, with the fore edge 32 of the hood 13 preferably overhanging the rear edge of the porcelain bowl cavity by the same distance as the height of the manifold inlet 15, or about ⅜" in the case depicted in the drawings attached hereto.

The portion of the wings 16 of the hood 13 extending rearward or aft of the mounting bolts is superfluous and is preferably trimmed away: i.e. removed by cutting, or, since the hood 13 is preferably made of plastic, snapped off with a flat rigid and hard object with a straight edge, such as a length of steel bar, first placed with an edge above the extent desired and the excess length of the two wings 16 pulled upward until separation is achieved. Assuming the hood 13 is made of thermoplastic, the preferred material, trimming the wings 16 can also be done with heat applied in a linear band across the desired trim line.

The heat can be supplied most easily by an electrical resistive element or a torch. It is not necessary to melt entirely through the intended part line. Once the substantially linear margin about the intended part line obtains a plastic state the excess portion of the wings 16 maybe moved upward, in a manner similar to that described directly above for snapping off the excess portion of the wings 16, and elongation of the linear margin in a plastic state will readily enable the excess portions to be removed by simply pulling the same away.

A smooth edge is obtained in this manner, in contrast to either cutting with a saw or snapping the excess wing 16 portions off as described directly above, and heat may also be applied after removal of the excess wing 16 portions by cutting or snapping to obtain a smooth edge. Alternatively, the sharp or rough edges obtained by cutting or snapping may be abraded smooth using a sanding block, sand paper, file, emery board, et cetera.

Injection molding of both the hood 13 and the manifold 11 in thermoplastic is the most preferred manner of manufacture of these components. While blow, i.e. vacuum, molding of the hood 13 is also attractive the precision obtainable with injection molding is not readily achievable by blow molding. Construction of either component can also be achieved by welding together sub-components. The medial section 36 of the hood 13 depicted in FIG. 3 is readily manufactured from molded thermoplastic sheet and welded to wings 16 either molded or cut from flat sheet. But integral construction is preferred.

Similarly, the manifold 11 depicted in FIG. 2 is readily welded or glued together from sub-components. The flat top including the two wings 16 each possessing one slot 17 can be molded or cut from flat sheet and attached to a injection or blow molded body for the manifold plenum 35 with the manifold extension 39 comprising a third sub-component attached to the body. The two vertical vanes 57 seen in FIG. 2 to divide the manifold inlet 15 into three air passageways can also comprise sub-components molded, cut, or cast from or into flat sheet and then attached to the manifold 11 in assembly. These vanes 57 are not necessary to fulfillment of the principles relating to the present invention but are useful in ensuring laminar air flow through the manifold inlet 15.

It is considered that while the blower 20 is a purchased component the size of the same must be in accordance with the system as installed and this depends upon the number of manifolds 11, the length of the conduit 30, the number of right angles in the conduit 30, and the size of the conduit 30, i.e. the total load, that this is expected to vary considerably and, further, that the size requirement of the blower 20 is not readily calculated. The sensor port 52 is provided primarily for assistance in installation. It can be used to size the blower 20 but, preferably, is used in conjunction with a regulator 70 preferably provided on the back of the blower housing 12 as seen in FIG. 8.

The purpose of the regulator 70 is primarily to allow use of a single size blower for most residential installations in which a maximum of three manifolds 11 are contemplated, a maximum load is known, and a standard, maximum load sized, blower 20 can be provided. In the case of maximum load the regulator 70 will be closed and otherwise it can be opened to compensate for lesser loads. Readings of volume air flow through a manifold 11 using a sensor port 53 provide empirical data for regulation of the compensation provided by the regulator 70. Opening the same reduces the pressure differential, and hence the measured air flow through, all the manifolds 11 in a system in accordance with the principles relating to the present invention.

The particular regulator 70 depicted in FIG. 8 is comprised simply of a sliding door 72 held in place by two spaced apart horizontal flanges 27 displaceable manually by means of a handle 73 in typically, as shown, partial closure of the orifice 71 preferably disposed, as depicted, on the back end of the blower housing 12, opposite the exhaust outlet 21. It is emphasized that any other configuration will suffice, that a round plate used as a door 72, for example, rotated to close and open the orifice 71 might be even simpler to implement and that multiple orifices 71 can be used as well.

FIG. 9 depicts use of a rectangular exhaust port 21 and disposition of a single relay 66 on the side of the blower housing 12 opposed to the inlet ports 22. None of this is necessary. It is simply suggested for the sake of convenience. A rectangular exhaust port 21 more readily conforms to the exhaust configuration of a typical blower and while it is preferred in installation to exhaust through 3" round metal duct an adapter 53 with one rectangular end and one round end will readily attach to the sleeve 23 of the rectangular exhaust port 21 depicted in FIG. 9 and facilitate attachment of 3" round metal conduit 30 in a manner similar to that depicted in FIG. 7. The adapter 53 depicted therein is intended to adapt 1.5" PVC conduit 30 to 3" round metal conduit 30 and it is suggested that it be made of PVC or another plastic. It is noted that the larger conduit 30 is seen to be fitted exteriorly to the adapter 53 while the smaller conduit 30 is inserted into the opposed end of the same and, as previously mentioned, is preferably threaded therein. An adapter 53 for a rectangular exhaust port 21 is preferably made of sheet metal and it is largely irrelevant as to whether the ends of the adapter 53 fit interiorly or exteriorly to the sleeve 23 about the exhaust port 21 or the end of the conduit 30 so connected.

It is emphasized that the foregoing is intended to provide one practiced in the art with the best known manner of making and using a system in preferred accordance with the principles relating to the present invention and the same is not to be construed in any manner as being restrictive of said principles nor of the rights and privileges obtained by Letters Patent for which

I claim:

1. A system intended to remove noxious odors resulting from disposal of human waste into the porcelain bowl of an ordinary flush toilet while seated upon its hinged seat spaced apart from and in contact with the top surface of said porcelain bowl and mounted to the rear of said top surface with a pair of mounting bolts; said system comprising:

at least one manifold, at least one hood, conduit, and at least one blower;

each said manifold possessing a manifold inlet, a manifold plenum, and a manifold extension with a manifold outlet;

said manifold inlet possessing dimensions sufficiently diminutive to fit the same in the space: between the hinged seat and the top surface of the porcelain bowl of an ordinary flush toilet and between the pair of mounting bolts mounting said hinged seat to the rear of the top surface of said porcelain bowl;

said manifold plenum possessing communication with said manifold inlet and said manifold extension facilitating air flow through said manifold inlet and then through said manifold plenum and thence through said manifold extension with a negative pressure differential with respect to ambient pressure supplied to said manifold extension;

said manifold extension being adapted for connection of said conduit to said manifold outlet;

each said blower being remotely located from said manifold and connected with said conduit such that operation of said blower effects the supply of a negative pressure differential upon said manifold inlet with said conduit connected to said manifold extension;

each said manifold further possessing two lateral wings each possessing one slot spaced apart from each other and possessing dimensions enabling the mounting bolts of an ordinary flush toilet to be passed therethrough in location of said manifold;

each said hood possessing a medial section and two lateral wings each possessing one slot spaced apart from each other and possessing dimensions enabling the mounting bolts of an ordinary flush toilet to be passed therethrough in location of said hood;

said medial section of said hood possessing a curved fore edge and a straight rear edge spaced apart from each other a distance sufficient to locate said curved fore edge in an overhang of the rear of the cavity of the porcelain bowl of an ordinary flush toilet and said straight rear edge in contact with said manifold inlet when both said manifold inlet and said hood are disposed upon the rear of the top surface of the porcelain bowl with the mounting bolts for the hinged seat passing through said slots through said wings of said hood and said wings of said manifold;

whereby operation of at least one said blower with said conduit connected to at least one said manifold extension effects a negative pressure differential upon said manifold inlet and air borne odors associated with disposal of human waste into the porcelain bowl of a flush toilet are removed with the flow of air under said medial section of said hood into said manifold inlet, through said manifold plenum, manifold extension, and conduit.

2. The system of claim 1 wherein said manifold inlet possesses at least one vertical vane facilitating laminar airflow therethrough.

3. The system of claim 1 wherein said manifold plenum possesses a rounded top facilitating laminar airflow therethrough.

4. The system of claim 1 wherein said slots through said wings of said manifold are open.

5. The system of claim 1 wherein said slots through said wings of said hood are closed.

6. The system of claim 1 wherein said manifold extension possesses a sensor port through which an airflow velocity probe may be inserted to determine the volume rate of air flow therethrough.

7. The system of claim 1 including an adapter for conduit of different sizes.

8. The system of claim 7 wherein said different sizes of conduit are comprised of schedule 40 PVC piping and three inch diameter metal ducting.

9. The system of claim 1 wherein said manifold extension possesses annular barbs facilitating the connection of flexible hose thereto.

10. The system of claim 1 possessing a hose connection permitting quick disconnection of the flexible hose to the manifold outlet.

11. The system of claim 10 wherein said hose connection and said manifold outlet each possess a pair of flanges facilitating fastening of said hose termination to said manifold outlet.

12. The system of claim 11 with a resilient gasket disposed between said hose termination and said manifold outlet to ensure an air tight seal.

13. The system of claim 1 wherein a vent in a room in which at least one said flush toilet is located is connected to said conduit.

14. The system of claim 1 wherein operation of said blower remote from said manifold is controlled by a light switch located in a room in which at least one said flush toilet is located.

15. The system of claim 14 wherein operation of said blower is controlled by said light switch using a relay connected by wiring to an electrical power supply.

16. The system of claim 15 wherein operation of said blower is controlled by said light switch using a relay connected by wiring to an electrical power supply and a printed circuit board facilitating control by a plurality of light switches.

17. The system of claim 1 wherein plastic piping possessing an outer diameter of no more than two inches is at least partly utilized for said conduit.

18. The system of claim 17 having said plastic piping possessing an outer diameter of no more than two inches run as conduit within the frame of a wall by hanging a length of said conduit from an aperture cut through a frame sill.

19. The system of claim 18 wherein said length of conduit is hung from a hanger possessing a shoulder larger than said aperture cut through a frame sill and at least one smaller end passable through said aperture.

20. The system of claim 19 wherein at least one said smaller end passable through said aperture of said hanger comprises a female connector end.

21. The system of claim 1 having one said blower disposed within a blower housing possessing one exhaust port and at least one inlet port connectable to conduit.

22. The system of claim 21 wherein said blower housing is constructed of sheet metal.

23. The system of claim 21 wherein said blower housing has a regulator permitting variable closure of an orifice through a wall of said blower housing.

24. The system of claim 22 wherein said regulator comprises a door with a handle permitting manually variable closure of said orifice.

25. The system of claim 21 wherein said exhaust outlet of said blower housing is round.

26. The system of claim 25 wherein said rectangular exhaust outlet of said blower housing possesses an exterior sleeve facilitating attachment of conduit with said exhaust outlet.

27. The system of claim 21 wherein said exhaust outlet of said blower housing is rectangular.

28. The system of claim 27 wherein said rectangular exhaust outlet of said blower housing possesses an exterior sleeve facilitating attachment of conduit with said exhaust outlet.

29. The system of claim 21 wherein said blower housing possesses more than one said inlet port each connectable to conduit enabling the delivery of a negative pressure differential to a plurality of manifold inlets each located upon one of a plurality of ordinary flush toilets.

30. The system of claim 29 wherein at least one said inlet port possesses an external sleeve facilitating connection of an end of round metal conduit thereto.

31. The system of claim 30 wherein said external sleeve possesses an annular flange with a fixed pattern of bolt holes.

32. The system of claim 31 including a reduction plate with a fixed pattern of bolt holes matching said fixed pattern of bolt holes in said annular flange of said external sleeve and a central aperture facilitating connection of the end of a length of plastic piping possessing a diameter of no more than two inches with the inlet port.

33. The system of claim 32 wherein said reduction plate possesses an external sleeve about said central aperture facilitating connection of the end of a length of plastic piping possessing a diameter of no more than two inches with the inlet port.

* * * * *